US005120044A

United States Patent [19]

Ettischer et al.

[11] Patent Number: 5,120,044

[45] Date of Patent: Jun. 9, 1992

[54] SUPPLY MAGAZINE FOR A SHEET STACK

[75] Inventors: Helmut Ettischer, Ostfildern; Anton Oswald, Esslingen, both of Fed. Rep. of Germany

[73] Assignee: Eastman Kodak Company, Rochester, N.Y.

[21] Appl. No.: 487,082

[22] Filed: Mar. 1, 1990

[30] Foreign Application Priority Data

Mar. 4, 1989 [DE] Fed. Rep. of Germany ..... 3906983

[51] Int. Cl.[5] ..... B65H 1/12

[52] U.S. Cl. ..... 271/127; 271/160

[58] Field of Search ..... 271/127, 117, 162, 164, 271/126, 160

[56] References Cited

U.S. PATENT DOCUMENTS

| | | | |
|---|---|---|---|
| 3,919,972 | 11/1975 | Komori | 271/127 X |
| 4,406,448 | 9/1983 | Kulpa et al. | 271/160 |
| 4,444,386 | 4/1984 | Murata | 271/127 |

FOREIGN PATENT DOCUMENTS

| | | | |
|---|---|---|---|
| 2616858 | 11/1983 | Fed. Rep. of Germany . | |
| 3642155 | 6/1988 | Fed. Rep. of Germany . | |
| 47739 | 3/1983 | Japan | 271/160 |

*Primary Examiner*—Richard A. Schacher
*Attorney, Agent, or Firm*—Lawrence P. Kessler

[57] ABSTRACT

A supply magazine (1) for a sheet stack (8) comprises a lower portion (2) which is open at the top and a cover (3) which covers the lower portion (2) at least in its sheet-removal area (roller 9) and can be opened. A pressure plate (4) pivotally mounted in the lower portion (2) is urged by springs (10) which spring-urge a sheet stack (8) arranged on the pressure plate (4) in the sheet-removal area against the inner side (3*d*) of the closed cover (3). As a result of the sheet stack (8) being pressed against the inner side of cover (3), it is so held by spring pressure that even if the supply magazine (1) is brought into an extremely inclined position during insertion into the copier or removal therefrom, the sheet stack (8) cannot be displaced and no sheets can drop out. With respect to the operative position of the supply magazine (1) in the copier, the distance of the pressure plate (4) from the inner side (3*d*) of the cover (3) is larger than the distance of the pressure plate from the operative area of the sheet-removal device (roller 9). As a result sheet stack (8) is lifted from the inner side (3*d*) of the cover (3) by an amount so that sheets can be separated without friction being exerted on them.

10 Claims, 7 Drawing Sheets

SUPPLY MAGAZINE FOR A SHEET STACK

BACKGROUND OF THE INVENTION

1. Field of the Invention

The invention relates to a supply magazine for sheets in a stack, which are separated from the upper side of the stack by a sheet-removal device of a copier and fed out through a recess in an end wall of the supply magazine at the removal side thereof, the supply magazine comprising a cover associated with the upper side of the sheet stack and not covering the engagement area of the sheet-removal device, and a pressure device associated with the lower side of the sheet stack and urging the stack by spring force into contact with the sheet-removal device.

2. Description of the Prior Art

In the case of a supply magazine of the above type which is known from U.S. Pat. No. 4,108,427 (issued Aug. 22, 1978, in the name of Shigehiro et al.), hold-down elements for the corners are arranged on the magazine in the area of sheet removal, the hold-down elements resting on the stack surface at the two ends of the front longitudinal side thereof where the sheets are removed. These hold-down elements serve for separating the uppermost sheet from the remaining stack when a sheet is to be removed. Such hold-down elements functions reliably only if the sheet stack, when loaded into the supply magazine, is shifted below them very carefully. For this purpose the sheet stack to be loaded along with its pressure device has to be depressed until the front side of the sheet stack can be shifted below the hold-down elements. But even if the hold-down elements rest on the sheet stack as required it has to be ensured that they do not become jammed by the stack but remain freely movable because otherwise functional reliability cannot be ensured. Although the hold-down elements exert a certain holding force on the front area of the sheet stack such force is not enough to prevent the sheet stack from slipping out of the supply magazine in the sheet-removal area if the supply magazine is brought into an inclined position, e.g. when it is inserted into a copier or removed therefrom. In the case of this known supply magazine the danger of the sheets slipping out results in particular from the fact that such hold-down elements cannot exert any influence on the front middle area of the upper side of the sheet stack whereby the sheet stack can curve and thus becomes unstable. Proper loading of a sheet stack into such a supply magazine requires great care and thus can only be carried out by specially trained staff.

SUMMARY OF THE INVENTION

This invention is directed to a supply magazine of the generic type such that a sheet stack can be easily loaded into the supply magazine and that the loaded stack maintains its functionally proper position even if the supply magazine is tilted. In accordance with the invention the lower portion of the supply magazine, which is adapted to receive the sheet stack, is completely open at the top, in that the cover is pivotable, shiftable or removable, in that the cover is arrestable in its covering position and in that the distance between the pressure device and the inner side of the cover is larger than the distance of the pressure device from the operative area of the sheet-removal device so that when the sheet-removal device is inoperative, the sheet stack is spring-urged into contact with the inner side of the cover.

According to a useful modification of the invention the pressure device associated with the lower side of the sheet stack is locked in a lower position and unlocked when the cover is closed so that the pressure device only becomes effective when the cover is closed. According to another useful modification of the invention the pressure device is controlled in response to the movement of the cover such that when the cover is open, the pressure device is positioned in a lower loading position in which a sheet stack can be loaded, and when the cover is closed, is lifted under spring urging into the position in which the sheet stack is pressed against the inner side of the cover.

The design of the supply magazine according to the invention is advantageous in that, on the one hand, a sheet stack can be readily loaded into the supply magazine which is completely open at the top, without any special insertion instructions having to be observed, and in that, on the other hand, after closing the cover the sheet stack is held in the supply magazine by spring force such that it is maintained in its proper functional position when the supply magazine is handled.

Due to this spring-urged holding, it is ensured that even if the supply magazine assumes an extremely inclined position during loading into, or unloading from the copier, the sheet stack cannot become displaced and sheets cannot drop out. This applies in an advantageous manner for any stack height possible so that also partially filled supply magazines can be handled without malfunctioning.

Advantageously, the supply magazine is designed such that when the sheet-removal device of the copier is rendered operative it lifts the sheet stack from the lower side of the cover so that the actual sheet removal occurs without any friction being exerted by the magazine. Thus it is also reached in a very advantageous manner that the sheet stack is permanently spring-urged into contact with a counter support (the inner side of the cover or sheet-removal device) and is thus always held against displacement or dropping out.

The invention, and its objects and advantages, will become more apparent in the detailed description of the preferred embodiments presented below.

BRIEF DESCRIPTION OF THE DRAWINGS

Further features and advantages can be inferred from the description of embodiments of the invention illustrated in the drawings in which.

DETAILED DESCRIPTION OF THE PREFERRED EMBODIMENTS

Referring now to the accompanying drawings, the supply magazine 1 according to the invention, hereinafter called magazine, is intended for use in an electrophotographic copier of a type known per se and not illustrated. In the copier, sheet-separating means are provided which are adapted to enter the magazine 1 and are not illustrated in detail. Such means are to ensure that one sheet at a time is fed out from the magazine 1. The sheet-separating means are not a subject matter of the invention and therefore are only shown in dash-dotted lines in the form of a rotatable roller 9 which separates the sheets by friction. The roller 9 arranged on the copier is stationarily mounted for rotation and is driven in the direction of the associated arrow (see FIG. 2).

Figure 1:
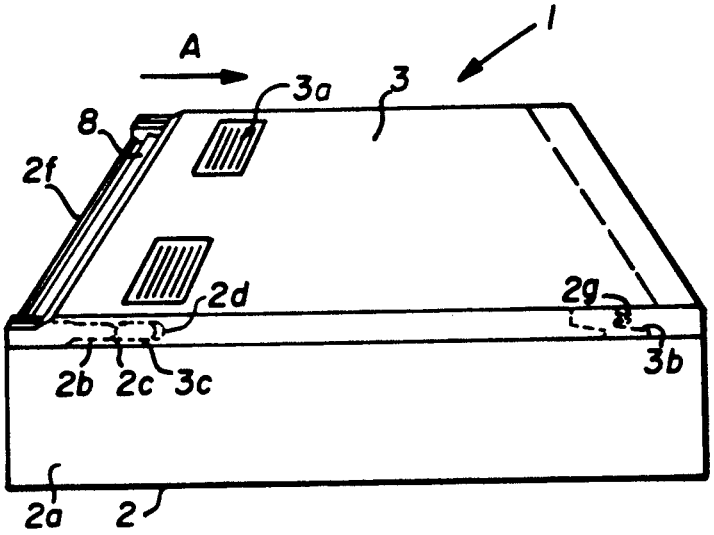
FIG. 1 is an oblique view of a supply magazine seen from the side.
Figure 2:
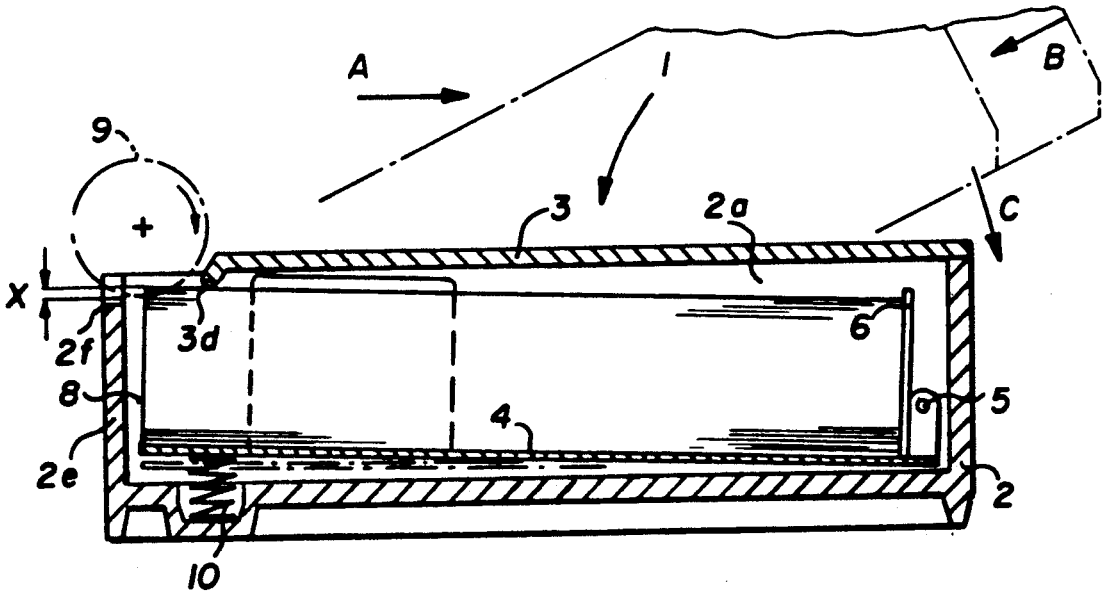
FIG. 2 is a longitudinal sectional view of the supply magazine according to FIG. 1.

Magazine 1 as illustrated in FIGS. 1 and 2 comprises a lower portion 2 and a lid 3. The lower portion 2 has the shape of a rectangular container which is freely accessible from the top. In the lower portion 2, a pressure plate 4 is located which is pivotally mounted about a journal 5 and urged by a spring 10. The pressure plate 4 is provided with size-limiting elements 6 and 7 which are adjustable to various paper sizes by means not illustrated. At least one of the size-limiting elements 6 and 7 is, moreover, provided with marks of a type known per se and not illustrated, such marks indicating the acceptable height of the sheet stack. A supply stack of copy paper, referred to in the following as sheet stack 8, is arranged on pressure plate 4.

When the sheet stack 8 has been inserted the lower portion 2 is covered by a lid 3 which leaves uncovered a sheet-removal area where the roller 9 of the copier sketched in the drawing can engage the sheet. Lid 3 can be slid onto lower portion 2 in the direction of the arrow "A" such that—as shown in dash-dotted lines on the right side of FIG. 1—it is placed on lower portion 2 and then shifted onto it in the direction of the arrow "A". During such sliding movement projections 3*c* provided on the two longitudinal sides of lid 3 are received in correspondingly designed grooves 2*b* in the side walls 2*a* of lower portion 2. Inclined surfaces 3*b* on lid 3, which are also arranged on either side, move below projections 2*g* arranged on the side walls 2*a*. The grooves 2*b* have resilient locking noses 2*c* and, when the lid 3 is slid on the lower portion as shown in FIG. 1, the projections 3*c* are fixed exactly in position between the ends of the grooves 2*d* and the locking noses 2*c*. To facilitate its sliding movement, the lid is provided with knurled grip surfaces 3*a* at its upper side. If the lid 3 is not properly placed on the lower portion 2 so that only the inclined surfaces 3*b* and the projections 2*g* are brought into engagement whereas the projections 3*c* and the grooves 2*b* are not, lid 3 can easily be removed without any damage. The inclined surfaces 3*b* also allow the lid 3 to be pivoted upwardly about the projections 2*g* of the lower portion 2 without any jamming or damage resulting therefrom.

At the lid end facing the sheet-removal area, the lower side of lid 3 comprises a pressure zone 3*d* against which the upper side of sheet stack 8 is held by spring urging as long as magazine 1 has not been attached to the copier. The pressure zone 3*d* comprises either a continuous elevation or intermittent elevations and extends across the whole width of the inner side of the lid so that sheet stack 8 can rest with its whole width uniformly and straightly against the inner side of the lid. The pressure zone 3*d* of lid 3 slid onto magazine 1 is arranged in a plane located by an amount X above the lower side of the stationary roller 9 of the copier, as can be seen from the operative position of magazine 1 shown in FIG. 2. As a result of this arrangement the advantage according to the invention is reached that the sheet stack 8 is spring-urged into contact with the pressure zone 3*d* of lid 3 as long as it is not depressed by roller 9.

This spring-urged contact of sheet stack 8 with pressure zone 3*d* of lid 3 allows magazine 1 to be brought into an inclined position, as shown, e.g. in dash-dotted lines in FIG. 2, without one or several of the upper sheets slipping out of the open sheet-removal area of magazine 1.

Magazine 1 is fixed on the copier (not illustrated) in such a position that the loaded sheet stack 8 is depressed by the stationary roller 9 by an amount X as shown in FIG. 2 and thus moved away from pressure zone 3*d*. As a result sheet stack 8 rests in a functionally suitable spring-urged position against roller 9 in the operative position of the magazine and a sheet can be removed without any friction force exerted by the magazine.

Magazine 1 is used in the following manner:

When a sheet stack 8 is to be loaded into magazine 1 which has been removed from the copier, lid 3 is slid off the lower portion 2 in opposition to the direction of the arrow "A" and sheet stack 8 placed into the open lower portion 2. Since the lower portion 2 is completely open at the top, sheet stack 8 can be placed easily and without fault on pressure plate 4 and between the size-limiting elements 6 and 7. When sheet stack 8 has been inserted, it is pressed downwardly with one hand and lid 3 is slid into position in the direction of the arrow "A" with the other hand. While lid 3 is being slid into position sheet stack 8 can be relieved of pressure. The pressure zone 3*d* of lid 3 slides along the upper surface of the stack until the locking position of the lid has been reached, the size-limiting element 6 serving as a counter support for the sheet stack 8 so that the position of the stack is not changed while the lid is being slid into position.

The closed magazine 1 can now be placed into the copier in that it is inserted in an inclined position of, e.g. 30 degrees as shown in FIG. 2, into a guide means (not illustrated) of the copier, in the direction of the arrow "B", and pivoted downwardly into its operative position in the direction of the arrow "C38. During such movement the open removal area of magazine 1 is first brought into a position below roller 9. During subsequent pivoting of magazine 1 in the direction of the arrow "C" the front area of sheet stack 8 is placed into contact with the stationary, drivable roller 9 and slightly depressed by an amount X by the roller in the manner described, the sheet stack 8 being thereby released from the pressure zone 3*d* of lid 3. In the operative position of magazine 1 now reached, the upper side of sheet stack 8 only rests against roller 9 so that sheets can be removed without any difficulties through a recess 2*f* provided in the end wall 2*e* of the lower portion 2.

When magazine 1 is to be removed from the copier this requires first of all a pivotal movement in opposition to the direction of the arrow "C" whereupon magazine 1 can be withdrawn in opposition to the direction of the arrow "B". If there are still sheets in the magazine 1 to be removed the roller 9 carries out a reverse rotary movement on the surface of the stack as long as roller 9 and stack 8 are held in engagement whereby the sheets are also prevented from slipping out in this phase. As soon as the roller 9 has been disengaged, sheet stack 8 is once again spring-urged into contact with the pressure zone 3*d* of lid 3 and is thus prevented from slipping out.

With reference to FIGS. 1 and 2, basic features have been described by which sheets are prevented from slipping out if magazine 1 is in an inclined position.

A further improvement of the handling of magazine 1 can be reached if the pressure plate 4 is locked in its lower position, when the sheet stack 8 is loaded, and is released to move upwardly automatically under spring force by the cover brought into its closing position.

Figure 4:
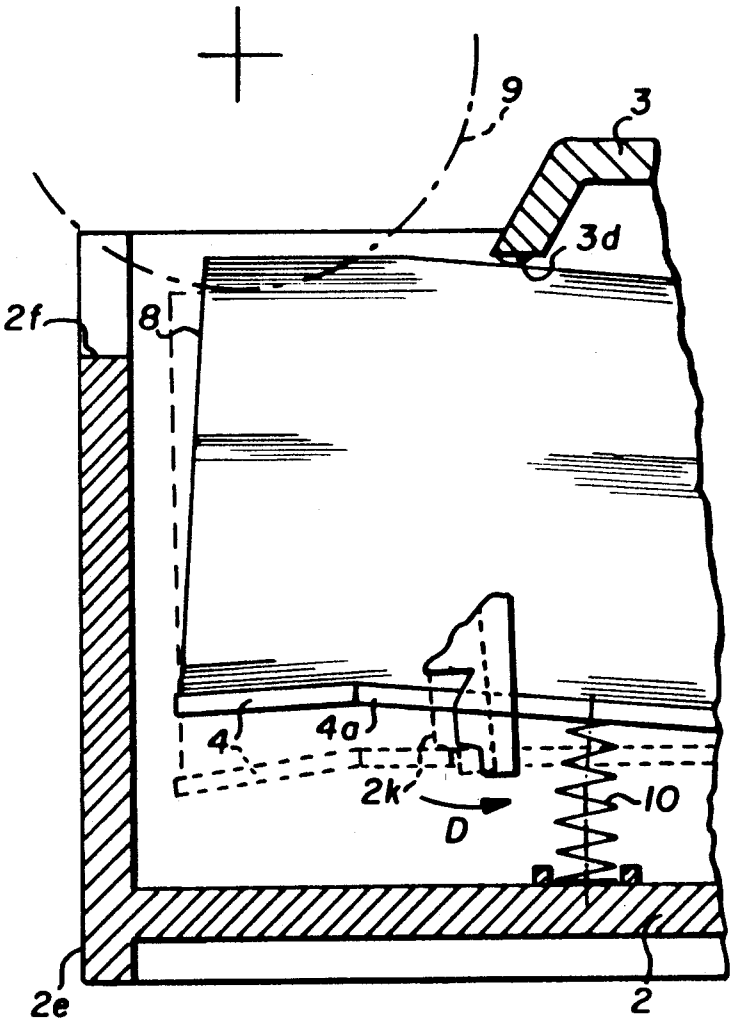
FIG. 4 is a view of the supply magazine according to FIG. 3 loaded with a sheet stack which rests against the cover.
Figure 3:
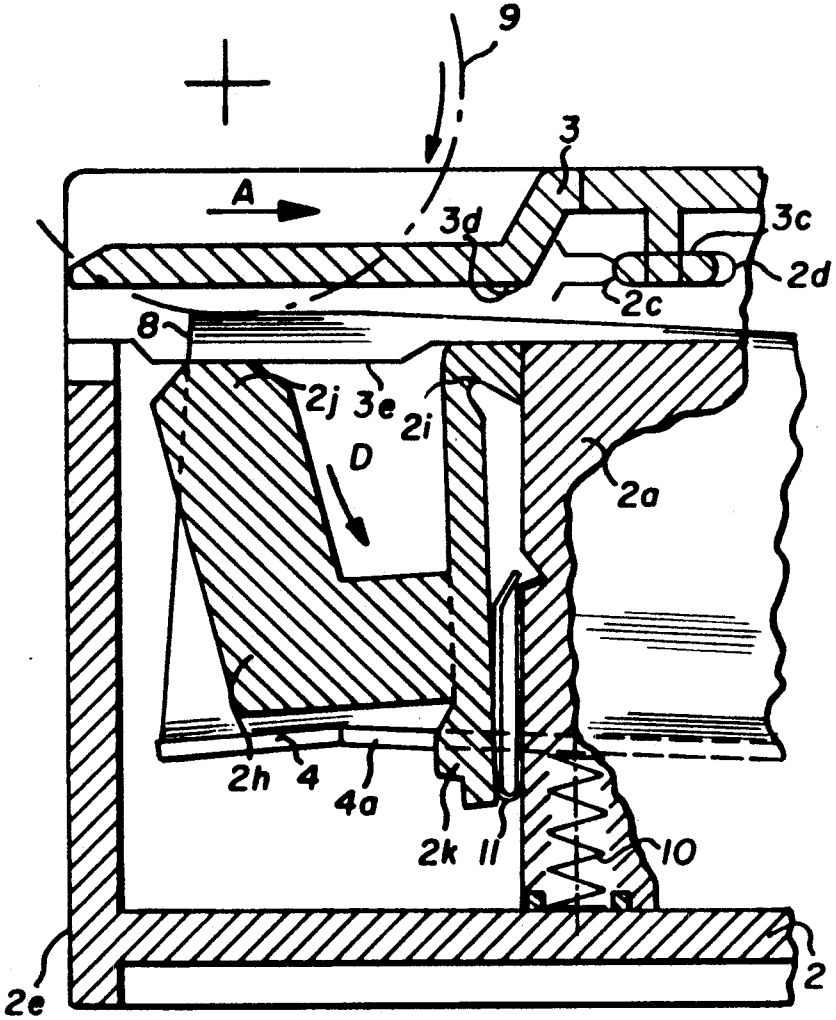
FIG. 3 is a partial view showing a section through a side wall of an embodiment of the supply magazine according to FIG. 2, in the sheet-removal position.

With reference to FIGS. 3 and 4 an embodiment is described which includes such a device for, respectively, locking and releasing a pressure plate, with parts corresponding to magazine 1 according to FIGS. 1 and 2 bearing identical reference numbers.

As shown in particular in FIG. 3, a pawl 2*h* is molded to either side wall 2*a* of the lower portion 2, such pawl having a resilient area 2*i* consisting of a thin portion of the material. Pawl 2*h* is associated with the free end of pressure plate 4. The pawl 2*h* features a locking nose 2*k* which is associated with a lug 4*a* of pressure plate 4, the lug extending into the operative area of locking nose 2*k*. The spring action of pawl 2*h* is enhanced by a leaf spring 11 inserted between pawl 2*h* and the side wall 2*a*. Arms 2*j* which extend into the path of sliding movement of lid 3 are molded to pawl 2*h*.

Lid 3 is provided with downwardly projecting ramps 3*e* which are associated with the arms 2*j* of the pawls 2*h*, the ramps 3*e* being arranged in the rear end area of lid 3 with respect to the direction of sliding "A".

In the case of this embodiment of magazine 1, a sheet stack 8 is loaded such that it is placed on the pressure plate 4 when the lid 3 is removed and is pressed downwardly by hand. In the lower position, the lugs 4*a* of the pressure plate 4 engage the locking noses 2*k* of the pawls 2*h* as shown in dash-dotted lines in FIG. 4. The magazine can of course also be loaded such that the pressure plate 4 is first depressed into its locking position and the sheet stack 8 inserted subsequently. Due to the fact that the pressure plate 4 is locked in its lower position, sheet stack 8 remains in its lower loading position so that the operator can use both hands to slide lid 3 onto the lower portion 2.

Now lid 3 is slid onto the lower portion 2 in the direction of the arrow "A", as was described in connection with FIGS. 1 and 2. At the end of such sliding movement the ramps 3*e* of lid 3 abut the arms 2*j* of the pawls 2*h* and urge them downwardly in the direction of the arrow "D". The locking noses 2*k* of the pawls 2*h* disengage the lugs 4*a* so that the pressure plate 4 along with the sheet stack 8 can pivot upwardly under the action of spring 10 until the upper side of sheet stack 8 rests under spring pressure on the pressure zone 3*d* of lid 3 (see FIG. 4).

As shown in FIG. 3, the ramps 3*e* of lid 3 and the arms 2*j* of the pawls 2*h* are provided with inclined surfaces to facilitate sliding. FIG. 3 also shows that the ramps 3*e* on lid 3 are made long enough for the pawls 2*h* to rest permanently in their depressed position when lid 3 is slid onto the lower portion so that the locking noses 2*k* remain outside the path of pivotal movement of the lugs 4*a*. This ensures that the released pressure plate 4 cannot relock with the pawls 2*k* and block them when the lid 3 is slid onto the lower portion. This is of particular importance if a sheet stack of excessive height is placed into the magazine 1 or if during handling of a loaded magazine 1, its pressure plate 4 is moved back into the actual locking area by inadvertent depression of the sheet stack 8 lying uncovered in the sheet-removal area. In either case locking of the pressure plate 4 in the closed condition of the magazine would cause the sheets to drop out by lack of pressure and malfunctioning to occur.

The pressure plate 4 comprises at its free end a slightly bent end area which, as can be seen in particular in FIG. 3, aligns the upper side of the sheet stack in the sheet-removal area about parallel with the sheet-removal direction and, moreover, slightly spreads the sheet stack 8. When magazine 1 has been loaded and closed, it is attached to the copier in the manner described in connection with FIG. 2, with the roller 9 engaging the upper side of the stack and depressing the stack slightly and thus separating it from the pressure zone 3*d* of lid 3.

In contrast to the above-described embodiment further modifications of the magazine are possible which will be described in the following. With respect to the advantages of the means which according to the invention are provided for holding the sheet stack 8 in the magazine against shifting or sliding out and with respect to the cooperation with the sheet-separating device (roller 9), all the following embodiments are similar. For the sake of simplicity, description of the further embodiments is therefore confined to the features differing from those described so far.

Figure 5:
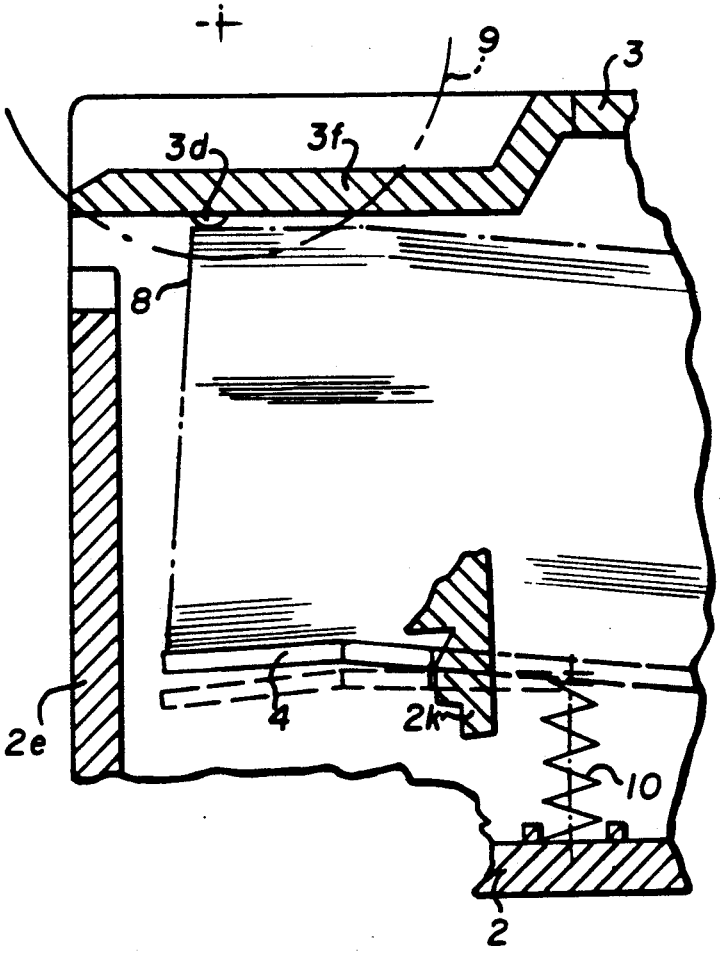
FIG. 5 is a partial sectional view of an embodiment of the supply magazine with a differently designed lid in the sheet-removal area.

The embodiment according to FIG. 5 substantially differs from the embodiment illustrated in FIG. 4 in that the lid 3 extends in the sheet-removal area up to the front end wall 2*e* of the lower portion 2 and is provided with slots (not illustrated) opening towards the end wall 2*e* and adapted to receive sheet-separating means (roller 9). In this case the pressure zone 3*d* is arranged directly at the front end of sheet stack 8 as can be seen from FIG. 5.

Figure 6:
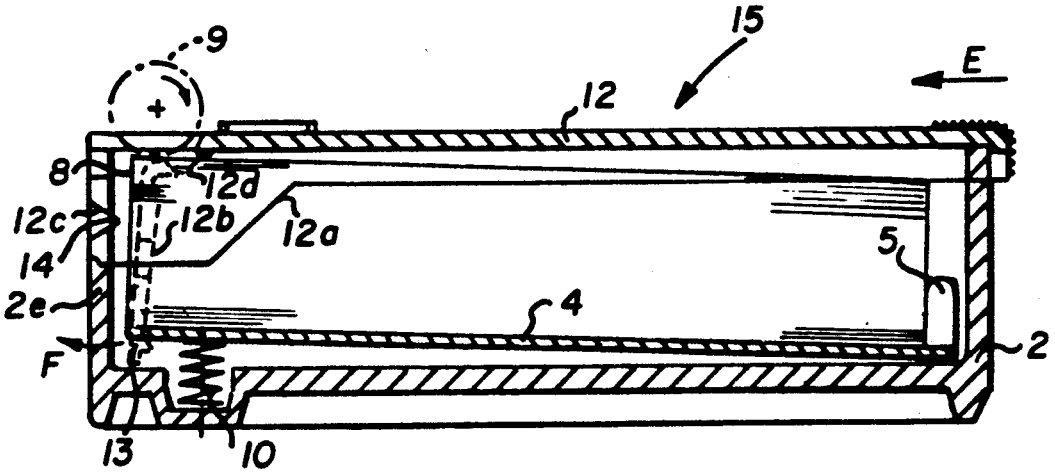
FIG. 6 is a longitudinal sectional view of an embodiment of a supply magazine.

In the case of the embodiment according to FIG. 6 a sliding lid 12 is shifted onto the lower portion 2 of a magazine 15 in a different direction, namely the direction of the arrow "E". The lower portion 2 is once again provided with resilient pawls 13 for locking the pressure plate 4. The lid 12 comprises projections 12*b* which are arranged on side portions 12 and are associated with the pawls 13 and is provided with funnel-shaped recesses 12*c* which serve to fix lid 12 in position on projections 14 arranged on the lower portion 2.

When lid 12 has been removed and a sheet stack 8 loaded and the pressure plate 4 depressed by hand to lock with the pawls 13, lid 12 is slid onto the lower portion 2 in the direction of the arrow "E". At the end of the sliding movement lid 12 is fixed in that the projections 14 are received in the funnel-shaped recesses 12*c* and in that the projections 12*b* make contact with the resilient pawls 13 so that said pawls are urged aside in the direction of the arrow "F". This releases the pressure plate 4 so that the sheet stack 8 can pivot upwardly under the action of spring 10 until it is spring-urged into contact with the pressure zone 12*d* of lid 12 and is secured in this position against slipping. When the magazine 15 is inserted in a copier, sheet stack 8 is slightly depressed by roller 9, as was described above, so that it no longer rests against the pressure zone 12*d*.

The following examples relate to magazine embodiments whose covers are pivotally linked to their lower portions.

Figure 7:
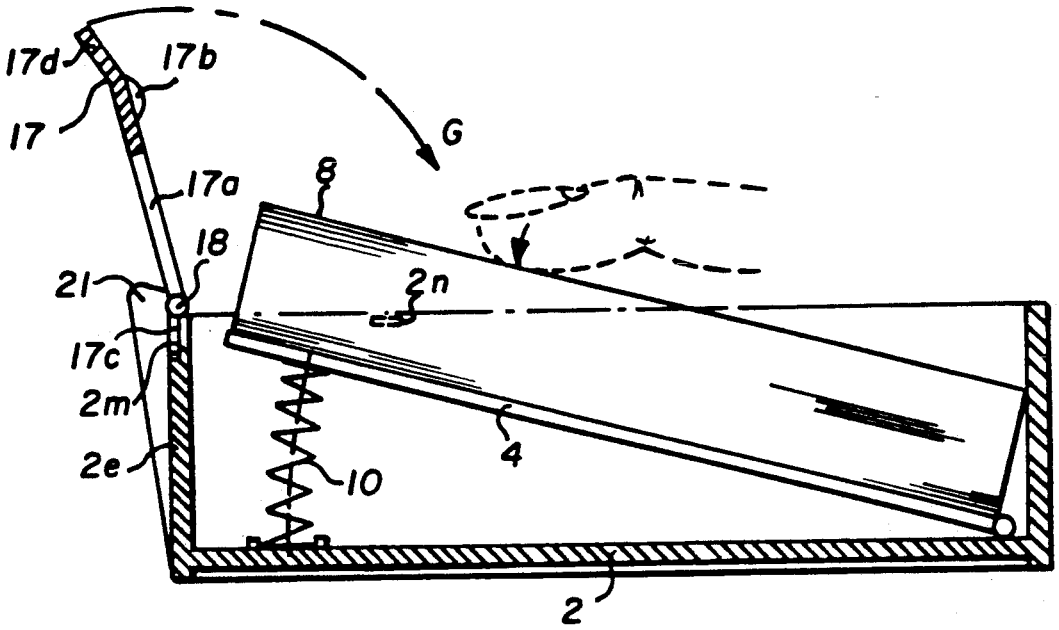
FIG. 7 is a longitudinal sectional view of an embodiment of a supply magazine with an open pivotal cover.
Figure 8:
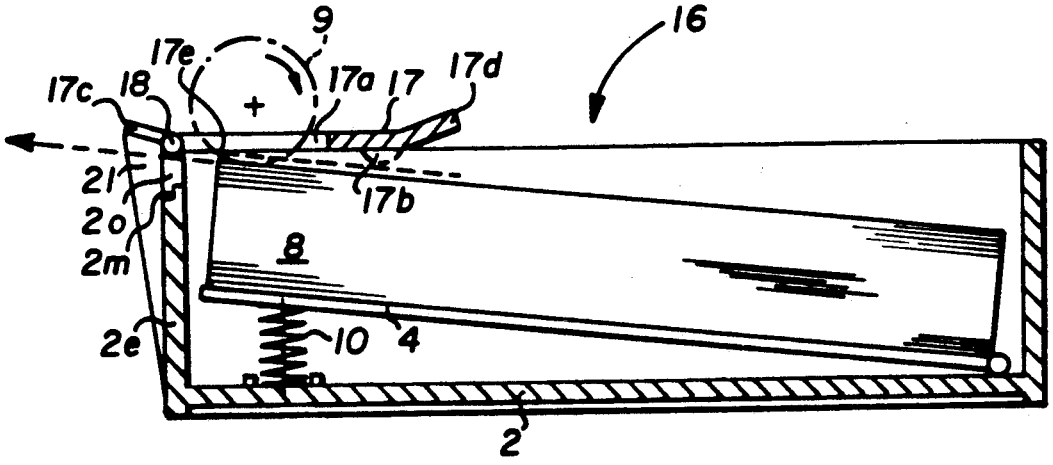
FIG. 8 is a view of the supply magazine according to FIG. 7 shown in its operative position.

Magazine 16 as shown in FIGS. 7 and 8 has a cover 17 which is pivotally mounted about a journal 18 on the lower portion 2. The cover 17 is seized at its free end 17*d* and engaged and disengaged respectively by means of locking projections 17*b* cooperating with locking recesses 2*n* arranged on either side of the lower portion 2. The cover 17 is provided with recesses 17*a* adapted for receiving the rollers 9. At the other end of cover 17, a short support arm 17*c* is provided which serves to limit the pivotal movement and rests against a step 2*m* of the end wall 2*e* of lower portion 2 when the cover 17 is in its open position. At the end wall 2*e*, walls 21 are arranged which project across the path of pivotal movement of support arm 17*c* and between which the support arm 17*c* is arranged such that it is protected from damage.

When cover 17 has been pivoted to its open position a sheet stack 8 is placed on the pressure plate 4 and lowered into the lower portion 2 in that it is pressed down by hand. Then the cover 17 is pivoted with the other hand onto the lower portion 2 in the direction of the arrow "G" and locked by depression of the locking means 2*n*, 17*b* on the lower portion 2. When the sheet stack 8 is released it pivots upwardly and, under the action of spring 10, comes to rest against the pressure zone 17*e* of cover 17. In the operative position of magazine 15, which is shown in FIG. 8, the sheet stack 8 is pressed downwardly by the rollers 9 so that the sheets can be fed out from magazine 16 through a slot 20 in the end wall 2*e* of lower portion 2.

Figure 9:
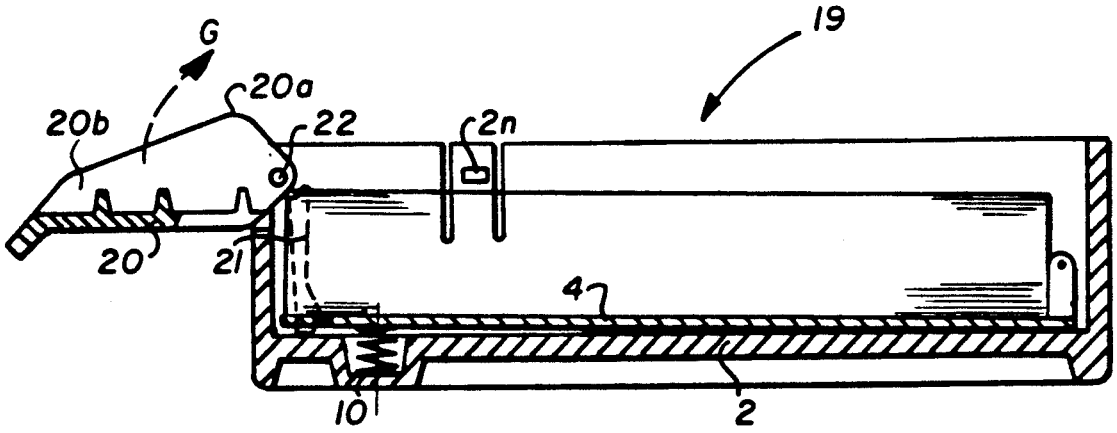
FIG. 9 is a longitudinal sectional view of an embodiment of a supply magazine with an open cover.
Figure 10:
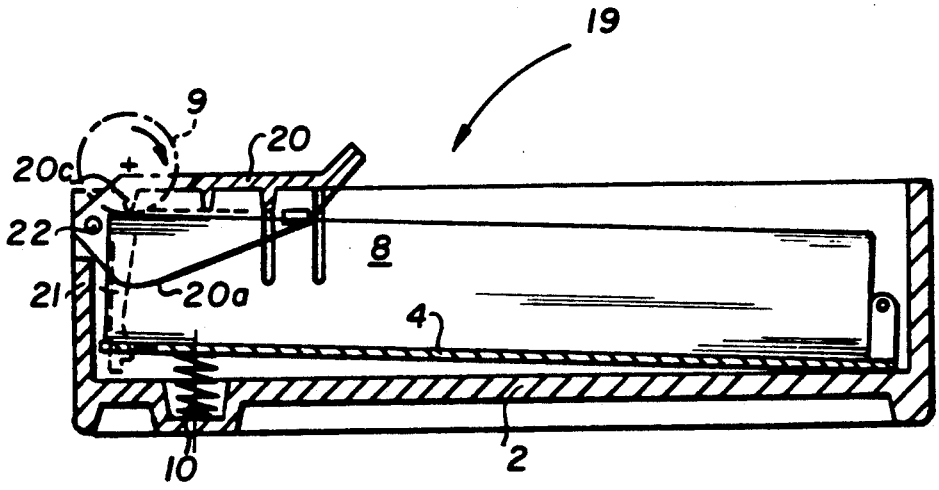
FIG. 10 is a view of the supply magazine according to FIG. 9 shown in its operative position.

In the following embodiment which is illustrated in FIGS. 9 and 10 resilient pawls 21 for locking the depressed pressure plate 4 are also arranged at the lower portion 2 of a magazine 19. When cover 20 which is pivotable about a journal 22 is pivoted to its closing position in the direction of the arrow "G", projections 20*a* arranged on said cover abut the pawls 21 (see FIG. 10) and pivot said pawls aside so that the pressure plate 4 is released. In its closing position, cover 20 locks in locking recesses 2*n* on lower portion 2. When pivoted upwardly, sheet stack 8 is once again spring-urged into contact with the pressure zone 20*c* of cover 20 and is thus secured against slipping.

In the case of the following embodiments the sheet stack need not be depressed by hand.

Figure 11:
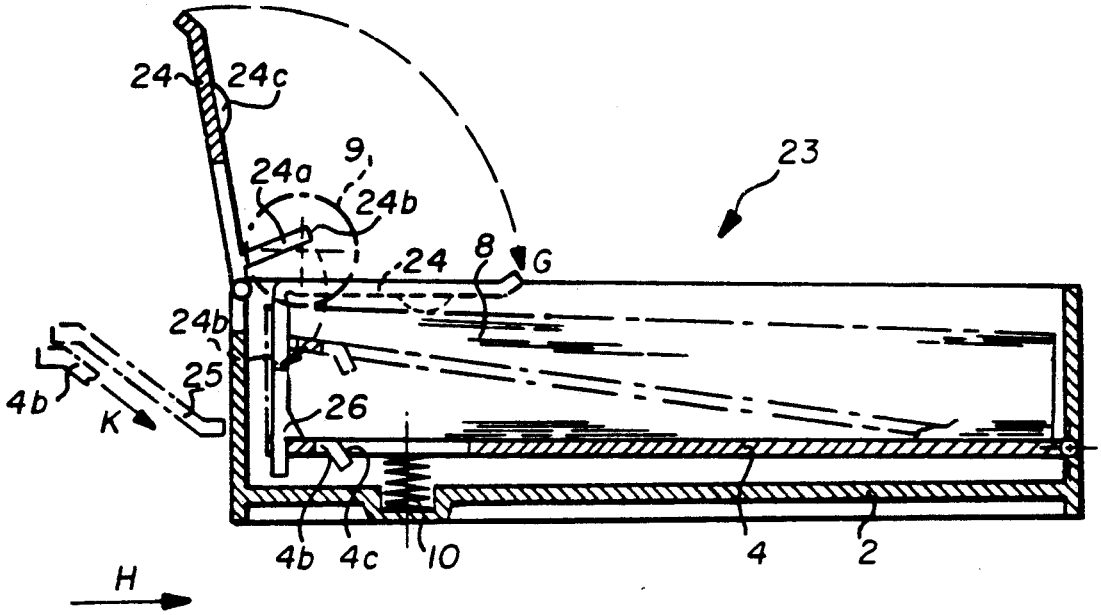
FIG. 11 is a longitudinal sectional view of an embodiment of a supply magazine with an automatic control of the pressure plate.

For this purpose a magazine 23 according to FIG. 11 has a pressure plate 4 which is provided with arms 4*b* having inclined surfaces 4*c* and projecting at either side from the lower portion 2. The arms 4*b*, 4*c* cooperate with ramps 25 (shown in dash-dotted lines) stationarily arranged on the copier such that when the magazine 23 is withdrawn in the direction of the arrow "H" from the copier not illustrated (see dash-dotted view) their inclined surfaces 4*c* slide along the ramp 25 in the direction of the arrow "K". During such movement the pressure plate 4 is pressed downwardly until it locks with resilient pawls 26 on the lower portion 2. After the magazine 23 has been removed from the copier sheet stack 8 is placed on the pressure plate 4, which is held in its lowermost position, with the cover 24 being pivoted to its open position as illustrated in FIG. 11.

Subsequently cover 24 is pivoted to its closing position in the direction of the arrow "G". Projections 24*b* molded to arms 24*a* of cover 24 make contact with the resilient pawls 26 and pivot the pawls such that the pressure plate 4 is released. Cover 24 locks by means of locking projections 24*c* with corresponding recesses of the lower portion 2. The released pressure plate 4 moves the sheet stack 8 into contact with a pressure zone (not illustrated) of cover 24 under the action of spring 10 as was described in connection with the previous embodiments. The ramp 25 of the copier does not hinder the subsequent insertion of the magazine 23 into the copier because the projecting arms 4*b* of pressure plate 4 are passed below the ramp 25.

Figure 12:
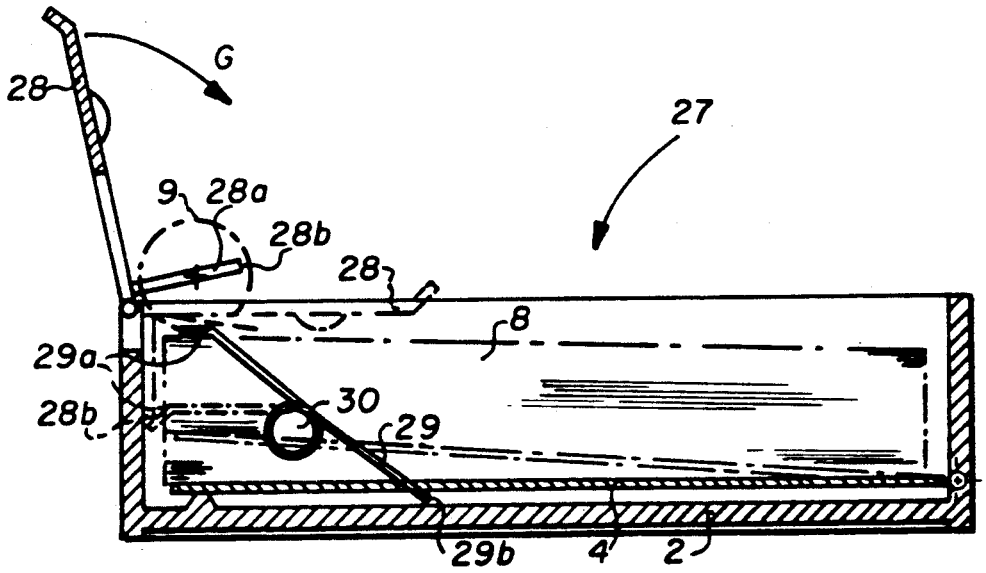
FIG. 12 is a longitudinal sectional view of an embodiment of a supply magazine with a pressure-plate control within the magazine.

In the case of the next embodiment which is shown in FIG. 12 the control of the pressure plate 4 is effected exclusively by the movement of the cover 28.

For this purpose leg springs 29 are arranged in a magazine 27 on pins 30 on either side of the side walls of the lower portion 2, each spring passing below the pressure plate 4 with a bent-off portion 29*b*. An arm 29*a* of the other leg of leg spring 29 is arranged in the path of movement of a projection 28*b* which is molded to an arm 28*a* of a pivotally mounted cover 28. As illustrated in FIG. 12, the leg springs 29 (of which only one is illustrated) rest with their bent-off portions 29*b* without urging below the pressure plate 4 lowered by the action of its own weight when cover 28 is pivoted to its open position. After a sheet stack 8 has been loaded into the lower portion 2, cover 28 is pivoted to its closing position in the direction of the arrow "G". During such movement the projections 28*b* abut the arms 29*a* of leg spring 29 and tension such arms. With the cover 28 pivoted to its closing position and locked, arm 29*a* of leg spring 29 is in the position shown in dash-dotted lines. The resultant urging of leg spring 29 has lifted the pressure plate 4 into the dash-dotted position so that sheet stack 8 is spring-urged at the pressure zone not illustrated into contact with the inner surface of cover 28 and is prevented from dropping out.

Figure 13:
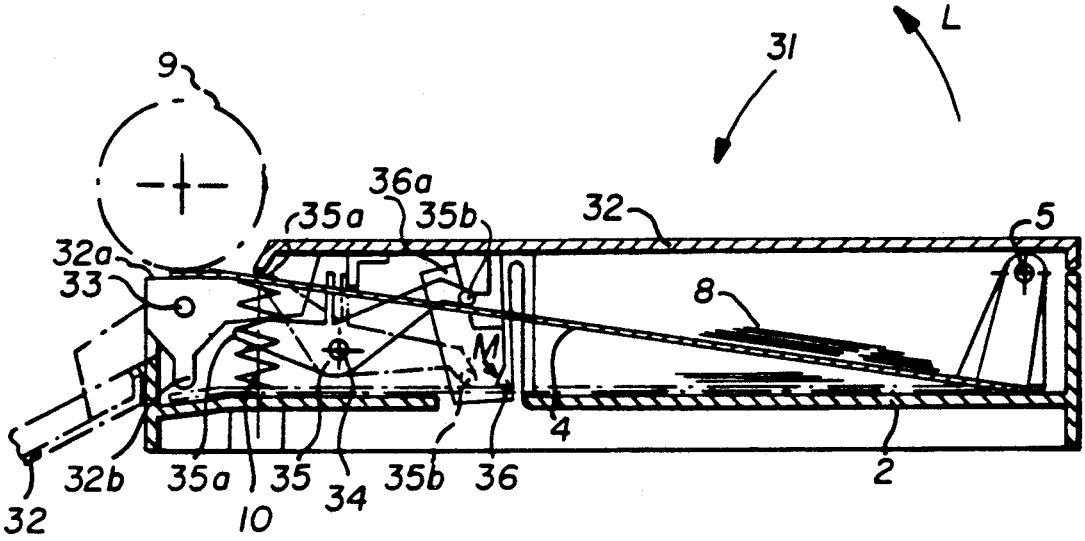
FIG. 13 is a longitudinal sectional view of a further embodiment of a supply magazine with a pressure-plate control within the magazine.

Still another magazine 31 is described with reference to FIG. 13. In this case the spring-urged pressure plate 4 is pressed into a lower loading position when lid 32 is pivoted to its open position. For this purpose lid 32, which is pivotable about a journal 33 on the lower portion 2, is provided with control arms 32*b* which carry out the pivotal movement as indicated in dash-dotted lines when lid 32 is open. Two oppositely located two-arm control levers 35 are provided (of which one is illustrated), such levers being movable respectively about pins 34 on the side walls of the lower portion 2. A first projection 35*a* of each control lever 35 extends into the path of pivotal movement of control arms 32*b*. A second projection 35*b* of each control lever 35 extends beyond the pressure plate 4 which is pivotable about a pin 5. Resilient pawls 36 are molded to the lower portion 2, such pawls being arranged at either side of the pressure plate 4 and having actuating arms 36*a* extending into the path of pivotal movement of lid 32.

When lid 32 is opened in the direction of the arrow "L" the control arms 32*b* pivot upwardly in a counterclockwise direction, abutting the first projections 35*a* and rotating the control lever 35 clockwise. During such movement the second projections 35*b* of the control lever 35 press the pressure plate 4 downwardly in opposition to the force of spring 10. When pressure plate 4 is in its lower loading position shown in dash-dotted lines it locks with the resilient pawls 36. When sheet stack 8 has been loaded lid 32 is closed again.

During the closing movement of lid 32 pressure plate 4, which is still locked, remains in its lower loading position. Only directly before reaching its closing position does lid 32 abut the arms 36*a* of the resilient pawls 36 and move such pawls in the direction of the arrow "M". As a result pressure plate 4 is released and pivots upwardly along with sheet stack 8 under the action of spring 10 until sheet stack 8 rests against the pressure zone on the inner side of the lid and is thus prevented from dropping out.

The pressure zone not illustrated and the recesses 32*a* on lid 32, which receive the rollers, as well as the locking means of lid 32 are designed in a manner corresponding to that in the previously described embodiments.

The covers of the embodiments described may be designed either as partial covers or, if protection from dust is desired, as a cover or slider completely covering the lower portion 2.

If the cover is designed as a partial cover it can also differ from the embodiments illustrated in that it is designed as a clamping member which can be plugged onto the lower portion 2 from above. Such a clamping member is attached at the point required for supporting the sheet stack to correspondingly designed guiding and locking means of the lower portion 2 and locked in that position.

If supply magazines for large sheet sizes necessitate bulky lids or sliders, a two-part cover could also be provided (not illustrated) of which the second part would not have any function with respect to the features according to the invention.

The invention has been described in detail with particular reference to presently preferred embodiments, but it will be understood that variations and modifications can be effected within the spirit and scope of the invention.

We claim:

1. Supply magazine for sheets arranged in a stack, which are separated from the top of the stack by a sheet-removal device of a copier and fed out through a recess in an end wall of the supply magazine at the removal side thereof, said supply magazine comprising a cover associated with the upper side of the sheet stack not covering the engagement area of said sheet-removal device and a pressure device associated with the lower side of the sheet stack urging said stack by spring force in a direction toward contact with the sheet-removal device, characterized in that the lower portion (2) of said supply magazine (1, 15, 19, 23, 27, 31) is adapted to receive a sheet stack (8), in that said cover (3, 12, 17, 20, 24, 28, 32) is movable relative to said lower portion to a covering position and is arrestable in its covering position, in that said pressure device (4) is arrestable by locking means (2*h*, 13, 21, 26) in an inoperative lower loading position, said locking means (2*h*13, 21, 26) extending into the path of said cover (3, 12, 20, 24) such that when said cover (3, 12, 20, 24) is in its covering position, said pressure device (4) is unlocked, and in that, with the sheet stack in said lower portion, the distance between said pressure device (4) and the inner side (3*d*, 12*d*, 17*e*, 20*c*) of said cover (3, 12, 17, 20, 24, 28, 32) is larger than the distance of said pressure device from the operative area of said sheet-removal device (9) so that when said sheet-removal device (9) is inoperative, the sheet stack (8) is spring-urged into contact with the inner side (3*d*, 12*d*, 17*e*, 20*c*) of said cover (3, 12, 17, 20, 24, 28, 32) in order to firmly hold the sheet stack in said supply magazine.

2. The supply magazine according to claim 1, characterized in that said cover (28, 32) is pivotably hinged to said lower portion (2), and in that said pressure device (4) is automatically coupled with said cover (28, 32) such that when said cover (28, 32) is opened, said pressure device is moved into a lower inoperative position, and when said cover (28, 32) is closed said pressure device is moved into its operative pressure position.

3. The supply magazine according to claim 1, characterized in that said pressure device consists of a pressure plate (4) pivotally mounted with one end (5) to said lower portion (2), the other free end of said pressure plate being spring-urged towards the sheet-removal area.

4. The supply magazine according to claim 3, characterized in that the inner side of said cover (3, 12, 17, 20, 24, 28, 32) comprises a pressure zone (3*d*, 12*d*, 17*e*) adapted for spring-urged contact with the sheet stack (8), said zone being arranged in the sheet-removal area extending across the whole width of said supply magazine (1, 15, 19, 23, 27, 31) and featuring at least elevated sections.

5. The supply magazine according to claim 3, characterized in that said cover is designed as a lid (3, 12) which can be slid onto said lower portion (2), and in that said locking means takes the form of a resilient pawl (2*h*, 13) extending into the sliding path of said lid (3, 12) and having a locking nose (2*k*, 13) associated with said pressure plate (4).

6. The supply magazine according to claim 3, characterized in that said cover is designed as a pivotally mounted lid (20, 24, 32), and in that said locking means takes the form of a resilient pawl (21, 26, 36, 36*a*) extending into the path of pivotal movement of said lid (20, 20*a*, 24, 24*b*, 32).

7. The supply magazine according to claim 3, characterized in that said cover is designed as a pivotable lid (28), in that at least one leg spring (29) is mounted to said lower portion (2), in that one arm (29*a*) of said leg spring extends into the path of pivotal movement of said lid (28), and in that the other arm (29*b*) of said leg spring engages below the free end of said pressure plate (4).

8. The supply magazine according to claim 3, characterized in that said cover is designed as a lid (32) pivotally mounted in the sheet-removal area, in that at least one control arm (32*b*) is arranged on said lid (32), in that a two-arm control lever (35) is pivotally mounted on said lower portion (2), in that one arm (35*a*) of said control lever extends into the path of pivotal movement of said control arm (32*b*), and in that the other arm (35*b*) of said control lever extends across the free end of said pressure plate (4).

9. The supply magazine according to claim 1, characterized in that said cover (3, 12, 32) completely covers said lower portion (2).

10. The supply magazine according to claim 1, characterized in that said cover (17, 20, 24, 28) substantially covers that area of said lower portion (2) which is necessary to ensure spring-urged contact with the sheet stack (8).

* * * * *